US008685504B2

(12) United States Patent
Nagashima et al.

(10) Patent No.: US 8,685,504 B2
(45) Date of Patent: Apr. 1, 2014

(54) RECORDING MEDIUM

(75) Inventors: Hitoshi Nagashima, Kawasaki (JP); Hiroshi Asakawa, Ebina (JP); Takatoshi Tanaka, Kawasaki (JP); Masaya Asao, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 13/151,944

(22) Filed: Jun. 2, 2011

(65) Prior Publication Data

US 2011/0300317 A1 Dec. 8, 2011

(30) Foreign Application Priority Data

Jun. 4, 2010 (JP) ..... 2010-129270

(51) Int. Cl.
*B41M 5/00* (2006.01)
*B41M 5/52* (2006.01)

(52) U.S. Cl.
CPC ..... *B41M 5/5218* (2013.01); *B41M 5/52* (2013.01); *B41M 5/5254* (2013.01)
USPC ..... 428/32.21; 428/32.31; 428/32.33; 428/32.35

(58) Field of Classification Search
CPC ..... B41M 5/5218; B41M 5/52; B41M 5/5254
USPC ..... 428/32.21, 32.31, 32.33, 32.35
See application file for complete search history.

(56) References Cited

U.S. PATENT DOCUMENTS 6,613,419 B2 * 9/2003 Ohbayashi et al. ..... 428/195.1

FOREIGN PATENT DOCUMENTS

| | | | |
|---|---|---|---|
| JP | 7-232473 | A | 9/1995 |
| JP | 9-066664 | A | 3/1997 |
| JP | 9-76628 | A | 3/1997 |
| JP | 2000-355160 | A | 12/2000 |
| JP | 2001-347753 | A | 12/2001 |
| JP | 2003-326838 | A | 11/2003 |
| JP | 2006-103103 | A | 4/2006 |

* cited by examiner

*Primary Examiner* — Betelhem Shewareged
(74) *Attorney, Agent, or Firm* — Canon U.S.A., Inc., IP Division

(57) ABSTRACT

A recording medium includes an ink-receiving layer formed by applying a coating liquid onto at least one surface of a substrate and drying the coating liquid, the coating liquid containing hydrated alumina and a binder, in which the hydrated alumina in the coating liquid has an average particle size of 100 nm to 250 nm, the surface of the ink-receiving layer has an arithmetic average roughness Ra of 0.8 μm to 2.5 μm, the arithmetic average roughness Ra being specified by JIS B0601:2001, and the surface of the ink-receiving layer has a specular gloss at 60° of 10.0% or less, the specular gloss at 60° being specified by JIS Z8741.

6 Claims, No Drawings

RECORDING MEDIUM

BACKGROUND OF THE INVENTION

1. Field of the Invention

The present invention relates to a recording medium.

2. Description of the Related Art

Recording media including porous ink-receiving layers having pigment particles and binders have been known.

Studies have recently been made to provide a recording medium with higher image quality by controlling various physical properties of a recording medium including an ink-receiving layer.

Japanese Patent Laid-Open No. 2006-103103 discloses a technique for relatively smoothing the surface roughness of an ink-receiving layer; specifically, the surface roughness of the ink-receiving layer is 0.3 μm or more and less than 0.8 μm in terms of arithmetic average.

SUMMARY OF THE INVENTION

According to one aspect of the present invention, a recording medium includes an ink-receiving layer formed by applying a coating liquid onto at least one surface of a substrate and drying the coating liquid, the coating liquid containing hydrated alumina and a binder, in which the hydrated alumina in the coating liquid has an average particle size of 100 nm to 250 nm, the surface of the ink-receiving layer has an arithmetic average roughness Ra of 0.8 μm to 2.5 μm, the arithmetic average roughness Ra being specified by JIS B0601: 2001, and the surface of the ink-receiving layer has a specular gloss at 60° of 10.0% or less, the specular gloss at 60° being specified by JIS Z8741.

Further features of the present invention will become apparent from the following description of exemplary embodiments.

DESCRIPTION OF THE EMBODIMENTS

The inventors have made an attempt to reduce the occurrence of undertrapping. Undertrapping is speculated to be a phenomenon due to the transfer of water and a water-soluble organic solvent contained in ink used to form the printed materials when a plurality of printed surfaces of printed materials are superimposed on each other. Specifically, undertrapping is speculated to be a phenomenon that occurs on the following principle: When two portions of printed materials where images are formed are brought into contact with each other, water and a water-soluble organic solvent in one printed material are transferred into the other printed material, thereby locally changing proportions of water and the water-soluble organic solvent in each of the printed materials. This causes a difference in haze between a portion where the proportions of water and the water-soluble organic solvent are changed and a portion where the proportions are not changed, thereby causing undertrapping. In particular, when the recording medium according to aspects of the present invention is used as an ink jet recording medium to which ink containing water and a water-soluble organic solvent is applied by an ink jet method, undertrapping is more likely to occur.

The inventors have conducted studies and have found that a recording medium including an ink-receiving layer having a relatively smooth surface roughness, for example, a recording medium described in Japanese Patent Laid-Open No. 2006-103103, has the following problems.

With respect to a plurality of printed materials obtained by applying ink to a recording medium, in the case where regions of the printed materials to which ink has been applied, i.e., ink-receiving layers to which ink has been applied, are stored while in contact with each other, part of an image of one printed material can become whitish (hereinafter, a phenomenon in which an image becomes whitish is also referred to as "undertrapping"). In particular, it was found that in the case where printed materials each obtained by applying ink to both surfaces of a recording medium are used as a booklet, such as a catalog or book, the ink-receiving layers are in contact with each other as described above when the booklet is closed, so that undertrapping is liable to occur.

When printed materials are used for a catalog or print on demand, the printed materials are spread on a desk or are exhibited indoors. So, the printed materials are exposed to light beams that are incident at various angles. The presence of a plurality of light sources that emit light beams incident on the ink-receiving layers of the printed materials at different incident angles can be liable to cause the diffused reflection of light, thereby reducing the legibility of an image.

To reduce the occurrence of undertrapping, the inventors were made an attempt to roughen surfaces of ink-receiving layers to reduce the contact area between the ink-receiving layers when recording media are superimposed. However, a reduction in the contact area between the ink-receiving layers, i.e., an increase in the unevenness of the surfaces of the ink-receiving layers to roughen the surfaces of the ink-receiving layers, caused significant light scattering at the surfaces of the ink-receiving layers, thereby reducing the legibility of images. Meanwhile, a reduction in the unevenness of the surfaces of the ink-receiving layers in order to reduce light scattering increases the contact area between the ink-receiving layers, thus leading to an insufficient reduction of the occurrence of undertrapping. As described above, there is a trade-off between the reduction of the occurrence of undertrapping and the inhibition of a reduction in legibility.

The inventors have conducted studies and have found that the reduction of the occurrence of undertrapping and the inhibition of the reduction in legibility are both satisfied by the strict control of the arithmetic average roughness Ra of a surface of an ink-receiving layer specified by JIS B0601: 2001, the specular gloss at 60° specified by JIS Z8741, the type of inorganic pigment, and the average particle size of the inorganic pigment.

The arithmetic average roughness Ra and the specular gloss at 60°, which are parameters that express the state of a surface of an ink-receiving layer, will be described below.

Arithmetic Average Roughness

A recording medium according to aspects of the present invention includes an ink-receiving layer on at least one surface of a substrate. In aspects of the present invention, the ink-receiving layer can be arranged on each surface of the substrate. The recording medium including the ink-receiving layers arranged on both surfaces of the substrate can be more suitable for printed materials in the form of a booklet, such as a catalog or book.

The surface of the ink-receiving layer of the recording medium according to aspects of the present invention has an arithmetic average roughness Ra of 0.8 μm to 2.5 μm, the arithmetic average roughness Ra being specified by JIS B 0601:2001. An arithmetic average roughness Ra of 0.8 μm or more results in a reduction in contact area between the ink-receiving layers when the ink-receiving layers are brought into contact with each other after printing. This reduces the transfer of water and a water-soluble organic solvent in ink between the ink-receiving layers, thus reducing the occurrence of undertrapping. Furthermore, an arithmetic average roughness Ra of 2.5 μm or less results in a recording medium having a surface roughness significantly suitable for a catalog and print on demand. The surface of the ink-receiving layer can have an arithmetic average roughness Ra of 1.1 μm to 2.5 μm. Specular Gloss at 60°

The surface of the ink-receiving layer of the recording medium according to aspects of the present invention has a specular gloss at 60° of 10.0% or less, the specular gloss at 60° being specified by JIS Z8741. The ink-receiving layer that satisfies the arithmetic average roughness Ra specified in aspects of the present invention has a relatively rough surface, so that the diffused reflection of light is likely to occur, thereby reducing the legibility of an image formed on the recording medium. In aspects of the present invention, a specular gloss at 60° of 10.0% or less effectively inhibits a reduction in legibility.

In aspects of the present invention, the reason the reduction in legibility is inhibited by setting the specular gloss of the ink-receiving layer at 60° to 10.0% or less is believed as follows: The specular gloss at 60° indicates the percentage of the quantity of light reflected from the recording medium with respect to the quantity of light incident on the recording medium. In the case where the specular gloss of the surface of the ink-receiving layer at 60° is set to 10.0% or less, the quantity of light reflected from the recording medium is reduced. The quantity of diffusely reflected light is included in the quantity of light reflected from the recording medium. Thus, the quantity of diffusely reflected light is reduced to inhibit the reduction in legibility. In aspects of the present invention, the specular gloss at 60° can be 9.0% or less. In aspects of the present invention, the lower limit of the specular gloss of the ink-receiving layer at 60° is not particularly limited. The lower limit of the specular gloss of the ink-receiving layer at 60° can be 3.0% or more in view of the ease of production of the recording medium.

Materials that can be suitably used for the recording medium according to aspects of the present invention will be described in detail below.

Ink-Receiving Layer

Hydrated Alumina

The recording medium according to aspects of the present invention includes the ink-receiving layer containing hydrated alumina. While an exact reason for this is not apparent, the use of the ink-receiving layer containing hydrated alumina effectively reduces undertrapping. A compound represented by, for example, general formula (X) can be suitably used as the hydrated alumina:

$$Al_2O_{3-n}(OH)_{2n}.mH_2O \quad (X)$$

(wherein n represents 0, 1, 2, or 3; m represents a value in the range of 0 to 10, such as 0 to 5, provided that both m and n are not zero at the same time; $mH_2O$ often represents an eliminable aqueous phase that is not involved in the formation of a crystal lattice, so that m may represent an integer or a noninteger; and when the material is heated, m may reach zero).

The crystal structure of the hydrated alumina is amorphous, gibbsite, or boehmite, depending on the temperature of heat treatment. In aspects of the present invention, a hydrated alumina having any of these crystal structures may be used. The crystal structure of the hydrated alumina may be determined by an X-ray diffraction method. In aspects of the present invention, hydrated alumina having a boehmite structure or amorphous structure can be used. Specific examples of hydrated alumina having a boehmite structure or amorphous structure include hydrated alumina described in Japanese Patent Laid-Open Nos. 7-232473, 8-132731, 9-66664, 9-76628, and so forth.

In aspects of the present invention, a coating liquid containing hydrated alumina and a binder is used when the recording medium is produced, as described below. The hydrated alumina contained in the coating liquid has an average particle size of 100 nm to 250 nm. An average particle size of the hydrated alumina of 100 nm or more results in inhibition of a reduction in legibility. An average particle size of the hydrated alumina of 250 nm or less results in a reduction in the occurrence of undertrapping. The hydrated alumina can have an average particle size of 140 nm to 200 nm. This more effectively inhibits the reduction in legibility.

In aspects of the present invention, the average particle size may be measured by a dynamic light scattering method and determined by analysis using a cumulant method. In the dynamic light scattering method, when fine particles having different particle sizes are present, there is a distribution in the decay of a time-correlation function obtained from scattered light. Analysis of the time-correlation function by a cumulant method provides the average (Γ) and dispersion (μ) of a decay rate. The decay rate (Γ) is expressed as a function of the diffusion coefficient and the scattering vector of particles. So, the hydrodynamic average particle size may be determined from the Stokes-Einstein equation. Specifically, the average particle size used herein may be measured with, for example, a zeta-potential & particle size analyzer (model: ELSZ-2, manufactured by Otsuka Electronics Co., Ltd).

An example of a method for producing a coating liquid containing hydrated alumina and a binder is a method including adding a binder to a colloidal sol containing hydrated alumina. In this case, the average particle size of the hydrated alumina in the colloidal sol may be used as the average particle size of hydrated alumina in the coating liquid. The reason for this is as follows: The average particle size of the hydrated alumina after the addition of the binder is equal to that that before the addition of the binder. In the case of the production of the coating liquid by the foregoing method, the addition of the binder to the hydrated alumina can increase the viscosity of the coating liquid, thereby causing difficulty in measuring the average particle size.

Additional Inorganic Pigment

According to aspects of the present invention, the ink-receiving layer may further contain an inorganic pigment other than hydrated alumina. Specific examples of the inorganic pigment other than hydrated alumina include white pigments, such as precipitated calcium carbonate, magnesium carbonate, kaolin, barium sulfate, aluminum silicate, magnesium silicate, synthetic amorphous silica, colloidal silica, and wet and dry silica sols.

In the case where hydrated alumina and an inorganic pigment other than hydrated alumina are used together, the hydrated alumina content of the ink-receiving layer may be 30% by mass or more, such as 70% by mass or more, and even 80% by mass or more with respect to the total mass of the inorganic pigment.

Binder

The ink-receiving layer according to aspects of the present invention contains a binder. Specific examples of the binder include polyvinyl alcohol (hereinafter, also referred to as "PVA"); oxidized starch, etherified starch, and phosphorylated starch; carboxymethyl cellulose, and hydroxyethyl cellulose; casein, gelatin, and soybean protein; conjugated polymer latexes, such as polyvinylpyrrolidone, maleic anhydride resins, styrene-butadiene copolymers, and methyl methacrylate-butadiene copolymers; acrylic polymer latexes, such as polymers of acrylic esters and methacrylic esters, vinyl polymer latexes, such as acrylic polymers and ethylene-vinyl acetate copolymers, melamine resins and urea resins; polymer and copolymer resins of acrylic esters and methacrylic esters, such as polymethyl methacrylate; polyurethane resins, unsaturated polyester resins, vinyl chloride-vinyl acetate copolymers, polyvinyl butyral, and alkyd resins. These binders may be used separately or in combination as a mixture.

In aspects of the present invention, PVA can be used as the binder. A common PVA, which is produced by hydrolysis of polyvinyl acetate, can be used as the binder. A modified PVA, such as a PVA with an end that is cationically modified or an anionically modified PVA having an anionic group, may be used. The PVA can have an average degree of polymerization of 1500 to 5000 and a saponification degree of 70 to 100. The binder content may be in the range of 5% by mass to 30% by mass and even 8% by mass to 20% by mass with respect to the hydrated alumina content of the ink-receiving layer.

Cross-Linking Agent

A cross-linking agent is not particularly limited. In the case where PVA is used as the binder, the cross-linking agent can be subjected to a crosslinking reaction with the PVA to cure the PVA. Specific examples of the cross-linking agent when PVA is used as the binder include boric acid compounds, such as orthoboric acid ($H_3BO_3$), metaboric acid, and hypoboric acid. Orthoboric acid can be used from the viewpoint of improving the temporal stability of the coating liquid and inhibiting cracking in the ink-receiving layer.

The boric acid compound can be used in an amount of 0.2 equivalents to 1.2 equivalents with respect to PVA in the ink-receiving layer. In aspects of the present invention, the theoretical amount of the cross-linking agent that reacts completely with all hydroxy groups contained in the PVA is defined as 1.0 equivalent. The use of the foregoing amount of the boric acid compound particularly improves the temporal stability of the coating liquid.

pH Regulator

The coating liquid used to form the ink-receiving layer may appropriately contain the following acid serving as a pH regulator. Examples thereof include organic acids, such as formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, aspartic acid, glutamic acid, pimelic acid, suberic acid, and methanesulfonic acid; and inorganic acids, such as hydrochloric acid, nitric acid, and phosphoric acid. In aspects of the present invention, a monobasic acid can be used in order to disperse hydrated alumina in water. Among these pH regulators, an organic acid, for example, formic acid, acetic acid, glycolic acid, or methanesulfonic acid or an inorganic acid, for example, hydrochloric acid or nitric acid, can be used.

Substrate

As a substrate for use in the recording medium according to aspects of the present invention, paper, such as cast coated paper, baryta paper, or resin coated paper (resin coated paper in which a base is coated with a resin, such as polyolefin) may be used. Furthermore, for example, a transparent thermoplastic film composed of polyethylene, polypropylene, polyester, polylactic acid, polystyrene, polyacetate, polyvinyl chloride, cellulose acetate, polyethylene terephthalate, polymethyl methacrylate, polycarbonate, or the like may be used. In addition to these materials, unsized paper or coated paper, which is appropriately sized paper, or a sheet-like material (e.g., synthetic paper) made of an opaque film obtained by filling an inorganic material or by fine foaming may be used. For example, a sheet made of glass or a metal may also be used. To improve the adhesive strength between the substrate and the ink-receiving layer, a surface of the substrate may be subjected to corona discharge treatment or any undercoating treatment.

Method for Producing Recording Medium

A method for producing a recording medium according to aspects of the present invention includes applying and drying the coating liquid that contains hydrated alumina and the binder. The hydrated alumina in the coating liquid has an average particle size of 100 nm to 250 nm.

In aspects of the present invention, a coating method of the coating liquid is not particularly limited. Examples of the coating method that can be employed include various curtain coaters, extrusion coaters, and slide hopper coaters. The coating liquid or a coater head may be heated to adjust the viscosity of the coating liquid at the time of coating.

Examples of a hot air dryer that can be used to dry the coating liquid include linear tunnel dryers, arch dryers, air-loop dryers, and sine-curve air float dryers. Furthermore, for example, a dryer using infrared rays, heating dryer, microwaves, or the like may be appropriately used.

In aspects of the present invention, it is important for the recording medium to satisfy the parameters, such as the arithmetic average roughness of the ink-receiving layer and the specular gloss of the ink-receiving layer at 60°, which are specified by aspects of the present invention. In aspects of the present invention, a specific method to satisfy the parameters is not particularly limited. A method for producing a recording medium that satisfies the parameters specified by aspects of the present invention will be described below in addition to factors that affect the parameters.

An example of the method to satisfy the parameters specified by aspects of the present invention is a method including treating a surface of an ink-receiving layer of a recording medium. Specifically, the method includes applying a coating liquid containing hydrated alumina and a binder onto a substrate, the hydrated alumina having an average particle size of 100 nm to 250 nm, drying the coating liquid to form the ink-receiving layer, and subjecting the surface of the ink-receiving layer to surface treatment using a roller having irregularities. The use of the roller having a high degree of irregularities increases the arithmetic average roughness Ra of the surface of the ink-receiving layer.

Another example of a method to satisfy the parameters specified by aspects of the present invention is a method in which the state of a surface of the substrate used to produce the recording medium and the amount of the coating liquid applied are allowed to fall within specific ranges. The details will be described below.

Substrate

The state of the surface of the substrate affects the state of a surface of the ink-receiving layer of the recording medium. Specifically, the arithmetic average roughness Ra, specified by JIS B0601:2001, of the surface of the ink-receiving layer tends to be lower than the arithmetic average roughness Ra, specified by JIS B 0601:2001, of the surface of the substrate. In aspects of the present invention, in the case where the surface of the substrate has an arithmetic average roughness Ra of 1.0 μm to 3.0 μm, the surface of the ink-receiving layer is easily adjusted so as to have an arithmetic average roughness Ra of 0.8 μm to 2.5 μm, which is the range specified by aspects of the present invention.

A method for controlling the arithmetic average roughness Ra, specified by JIS B0601:2001, of the surface of the substrate is not particularly limited. In the case where the substrate is resin-coated paper, the surface of the substrate can be subjected to embossing treatment with a cooling roller having random shaped irregularities. An increase in the irregularities of the cooling roller increases the arithmetic average roughness Ra of the surface of the substrate. In the case where the substrate is resin-coated paper, the change of the shape of the embossed surface of the substrate due to changes in humidity and temperature can be inhibited.

The specular gloss, specified by JIS Z8741, of the surface of the ink-receiving layer at 60° tends to be higher than the specular gloss, specified by JIS Z8741, of the surface of the substrate at 60°. In aspects of the present invention, in the case where the surface of the substrate has a specular gloss at 60° of 7.0% or less, the surface of the ink-receiving layer is easily adjusted so as to have a specular gloss at 60° of 10.0% or less, which is the range specified by aspects of the present invention.

A method for controlling the specular gloss, specified by JIS Z8741, of the surface of the substrate at 60° is not particularly limited. In the case where the substrate is resin-coated paper, the surface of the substrate can be subjected to embossing treatment with a cooling roller having random shaped irregularities. The density of the resin, such as polyethylene, may be adjusted by the pressing force of the irregularities of the cooling roller against the surface of the substrate, thereby controlling the refractive index of the resin and the specular gloss of the surface of the substrate at 60°.

Ink-Receiving Layer

The thickness of the ink-receiving layer affects the specular gloss of the ink-receiving layer at 60°. Specifically, an increase in the thickness of the ink-receiving layer has a tendency to lead to an increase in the specular gloss of the ink-receiving layer at 60°. In aspects of the present invention, in the case where the coating liquid containing hydrated alumina and the binder is applied in such a manner that the resulting layer has a dry thickness of 10 μm to 25 μm, the surface of the ink-receiving layer is easily adjusted so as to have a specular gloss at 60° of 10.0% or less, which is the range specified by aspects of the present invention.

In aspects of the present invention, the thickness of the ink-receiving layer of the recording medium may be measured by a method described below. The cross section of the recording medium is exposed with a microtome. The exposed cross section is observed with a scanning electron microscope (S-4800, manufactured by Hitachi High-Technologies Corporation). The thickness of the exposed cross section of the ink-receiving layer is determined on the basis of a scale on the resulting image. Similar operations are performed at nine different portions where cross sections are exposed. The average thickness is calculated from the resulting data at 10 portions. In aspects of the present invention, the average thickness obtained by the foregoing operations is defined as the thickness of the ink-receiving layer of the recording medium.

In aspects of the present invention, the ink-receiving layer may be subjected to surface treatment or a surface treatment layer may be arranged on the surface of the ink-receiving layer as long as the parameters, such as the arithmetic average roughness of the ink-receiving layer and the specular gloss of the ink-receiving layer at 60°, which are specified by aspects of the present invention, are satisfied.

EXAMPLES

Aspects of the present invention will be more specifically described below by examples. The following examples serve as specific examples for a deeper understanding of aspects of the present invention. The present invention is not limited to these examples. In the following examples, "part(s)" and "%" are on a mass basis unless otherwise specified.

Production of Recording Medium

Preparation of Substrate

Precipitated calcium carbonate (20 parts) was added to a slurry of Laubholz bleached kraft pulp (100 parts). Cationized starch (2 parts) and an alkenyl succinic anhydride-based neutral sizing agent (0.3 parts) were added thereto. The mixture was sufficiently mixed to provide a paper material. The resulting paper material was dried with a Fourdrinier multicylinder machine so as to have a water content of 10%. A solution of 7% oxidized starch was applied onto each surface of the paper material at 4 g/m$^2$ with a size press and dried so as to have a water content of 7%, thereby producing base paper having a basis weight of 110 g/m$^2$. A resin composition containing high-density polyethylene (20 parts) and low-density polyethylene (70 parts) was applied by melt extrusion onto each of the surfaces of the base paper in a coating weight of 30 g/m$^2$ per surface. Immediately after performing the melt extrusion, polyethylene surfaces were subjected to embossing treatment using a cooling roller having an irregular surface with the base paper cooled, thereby providing a substrate having a basis weight of 170 g/m$^2$. Substrates A to G having different values of the arithmetic average roughness Ra and different values of the specular gloss at 60° were produced by adjusting the pressing force of the cooling roller and the height of the irregularities of the cooling roller during the embossing treatment. Methods for measuring the arithmetic average roughness Ra of the substrate and the specular gloss of the substrate at 60° are described below.

Measurement of Arithmetic Average Roughness Ra

The arithmetic average roughness Ra of the surfaces of the substrates was measured with a measuring apparatus under measurement conditions described below.

Measuring apparatus: Surfcorder SE3500 (manufactured by Kosaka Laboratory Ltd.)

Measurement conditions: A cutoff value was set according to JIS B0601:2001. The evaluation length was set to a length five times the cutoff length.

Measurement of Specular Gloss at 60°

The specular gloss of each surface of the substrates at 60° was measured with a measuring apparatus under measurement conditions described below.

Measuring apparatus: VG 2000 (manufactured by Nippon Denshoku Industries Co., Ltd.)

Measurement conditions: Measurement conditions complied with JIS Z8741.

Table 1 shows the arithmetic average roughness of the surfaces of substrates A to G and the specular gloss of the surfaces of substrates A to G at 60° obtained by the foregoing measurement methods.

TABLE 1

| | Arithmetic average roughness Ra (μm) | Specular gloss at 60° (%) |
|---|---|---|
| Substrate A | 1.0 | 7.0 |
| Substrate B | 3.0 | 7.0 |
| Substrate C | 1.4 | 7.0 |
| Substrate D | 2.0 | 7.0 |
| Substrate E | 0.8 | 7.0 |
| Substrate F | 1.4 | 10.0 |
| Substrate G | 5.0 | 7.0 |

Preparation of Coating Liquid a for Ink-Receiving Layer

Hydrated alumina (Disperal HP 14, manufactured by Sasol Co.) was added to ion exchanged water in an amount of 30%.

Methanesulfonic acid was added thereto in an amount of 1.5 parts with respect to 100 parts of hydrated alumina. The mixture was stirred to form a colloidal sol. The resulting colloidal sol was appropriately diluted with ion exchanged water so as to have a hydrated alumina content of 27%, thereby providing colloidal sol A. The average particle size of hydrated alumina in colloidal sol A was measured with a zeta-potential & particle size analyzer (model: ELSZ-2, manufactured by Otsuka Electronics Co., Ltd) and found to be 144 nm.

A polyvinyl alcohol (PVA 235, manufactured by Kuraray Co., Ltd., degree of polymerization: 3500, saponification degree: 88%) was dissolved in ion exchanged water to form an aqueous solution of 8.0% PVA. The resulting PVA solution was mixed with colloidal sol A in such a manner that the PVA content was 10% with respect to hydrated alumina. An aqueous solution of 3.0% boric acid was added thereto in such a manner that the boric acid content was 2.0% with respect to hydrated alumina, thereby providing coating liquid A for an ink-receiving layer.

Preparation of Coating Liquid B for Ink-Receiving Layer

Colloidal sol B and coating liquid B for an ink-receiving layer were prepared in the same way as the preparation of coating liquid A for an ink-receiving layer, except that Disperal HP 18 (manufactured by Sasol Co.) was used in place of Disperal HP 14 (manufactured by Sasol Co.), which is hydrated alumina in coating liquid A for an ink-receiving layer, and that the amount of methanesulfonic acid added was set to 1.2 parts with respect to 100 parts of hydrated alumina. The average particle size of hydrated alumina in colloidal sol B was measured with a zeta-potential & particle size analyzer (model: ELSZ-2, manufactured by Otsuka Electronics Co., Ltd) and found to be 168 nm.

Preparation of Coating Liquid C for Ink-Receiving Layer

Colloidal sol C and coating liquid C for an ink-receiving layer were prepared in the same way as the preparation of coating liquid A for an ink-receiving layer, except that Disperal HP 10 (manufactured by Sasol Co.) was used in place of Disperal HP 14 (manufactured by Sasol Co.), which is hydrated alumina in coating liquid A for an ink-receiving layer, and that the amount of methanesulfonic acid added was set to 1.8 parts with respect to 100 parts of hydrated alumina. The average particle size of hydrated alumina in colloidal sol C was measured with a zeta-potential & particle size analyzer (model: ELSZ-2, manufactured by Otsuka Electronics Co., Ltd) and found to be 118 nm.

Preparation of Coating Liquid D for Ink-Receiving Layer

Colloidal sol D and coating liquid D for an ink-receiving layer were prepared in the same way as the preparation of coating liquid A for an ink-receiving layer, except that Disperal 40 (manufactured by Sasol Co.) was used in place of Disperal HP 14 (manufactured by Sasol Co.), which is hydrated alumina in coating liquid A for an ink-receiving layer, and that the amount of methanesulfonic acid added was set to 1.0 part with respect to 100 parts of hydrated alumina. The average particle size of hydrated alumina in colloidal sol D was measured with a zeta-potential & particle size analyzer (model: ELSZ-2, manufactured by Otsuka Electronics Co., Ltd) and found to be 300 nm.

Preparation of Coating Liquid E for Ink-Receiving Layer

Silica (A300, manufactured by Nippon Aerosil Co., Ltd.) (100 parts) and a cationic polymer (SHALLOL DC 902P) (4 parts) were dispersed in ion exchanged water in such a manner that the silica solid content was 18%. The mixture was dispersed with a high-pressure homogenizer to provide colloidal sol E. The average particle size of silica in colloidal sol E was measured with a zeta-potential & particle size analyzer (model: ELSZ-2, manufactured by Otsuka Electronics Co., Ltd) and found to be 160 nm.

A polyvinyl alcohol (PVA 235, manufactured by Kuraray Co., Ltd., degree of polymerization: 3500, saponification degree: 88%) was dissolved in ion exchanged water to form an aqueous solution of 8.0% PVA. The resulting PVA solution was mixed with colloidal sol E in such a manner that the PVA content was 20% with respect to silica. An aqueous solution of 3.0% by mass boric acid was added thereto in such a manner that the boric acid content was 3.5% with respect to silica, thereby providing coating liquid E for an ink-receiving layer.

Preparation of Coating Liquid F for Ink-Receiving Layer

Coating liquid E for an ink-receiving layer was mixed with coating liquid A for an ink-receiving layer (average particle size of hydrated alumina: 144 nm) in such a manner that the ratio by mass of hydrated alumina to silica was 3:7, thereby providing coating liquid F for an ink-receiving layer.

Preparation of Coating Liquid G for Ink-Receiving Layer

Coating liquid E for an ink-receiving layer was mixed with coating liquid A for an ink-receiving layer (average particle size of hydrated alumina: 144 nm) in such a manner that the ratio by mass of hydrated alumina to silica was 7:3, thereby providing coating liquid G for an ink-receiving layer.

Example 1

Coating liquid A for an ink-receiving layer was applied onto substrate A in a dry coating weight of 20 g/m$^2$ and then dried at 60° C. to provide recording medium 1. The cross section of recording medium 1 was exposed with a microtome. The exposed cross section was observed with a scanning electron microscope (S-4800, manufactured by Hitachi High-Technologies Corporation). The thickness of the ink-receiving layer of recording medium 1 was determined on the basis of a scale on the resulting image. Similar operations were performed at nine different portions where cross sections were exposed. The average thickness was calculated from the resulting data at 10 portions. The resulting average thickness was defined as the thickness of the ink-receiving layer of recording medium 1. Table 2 shows the thickness of the ink-receiving layer of recording medium 1 and the type of inorganic pigment contained in the ink-receiving layer and the average particle size of hydrated alumina contained in the coating liquid.

Example 2

Recording medium 2 was produced in the same way as in Example 1, except that substrate B was used in place of substrate A. Table 2 shows the thickness of the ink-receiving layer of recording medium 2 and the type of inorganic pigment contained in the ink-receiving layer and the average particle size of hydrated alumina contained in the coating liquid.

Example 3

Recording medium 3 was produced in the same way as in Example 1, except that substrate C was used in place of substrate A and that the coating weight of coating liquid A for an ink-receiving layer was changed in such a manner that the dry coating weight of coating liquid A for an ink-receiving layer was 25 g/m$^2$. Table 2 shows the thickness of the ink-receiving layer of recording medium 3 and the type of inorganic pigment contained in the ink-receiving layer and the average particle size of hydrated alumina contained in the coating liquid.

Example 4

Recording medium 4 was produced in the same way as in Example 1, except that substrate D was used in place of substrate A. Table 2 shows the thickness of the ink-receiving layer of recording medium 4 and the type of inorganic pigment contained in the ink-receiving layer and the average particle size of hydrated alumina contained in the coating liquid.

Example 5

Recording medium 5 was produced in the same way as in Example 1, except that substrate C was used in place of substrate A and that the coating weight of coating liquid A for an ink-receiving layer was changed in such a manner that the dry coating weight of coating liquid A for an ink-receiving layer was 15 g/m$^2$. Table 2 shows the thickness of the ink-receiving layer of recording medium 5 and the type of inorganic pigment contained in the ink-receiving layer and the average particle size of hydrated alumina contained in the coating liquid.

Example 6

Recording medium 6 was produced in the same way as in Example 1, except that coating liquid B for an ink-receiving layer was used in place of coating liquid A for an ink-receiving layer. Table 2 shows the thickness of the ink-receiving layer of recording medium 6 and the type of inorganic pigment contained in the ink-receiving layer and the average particle size of hydrated alumina contained in the coating liquid.

Example 7

Recording medium 7 was produced in the same way as in Example 1, except that substrate B was used in place of substrate A and that coating liquid B for an ink-receiving layer was used in place of coating liquid A for an ink-receiving layer. Table 2 shows the thickness of the ink-receiving layer of recording medium 7 and the type of inorganic pigment contained in the ink-receiving layer and the average particle size of hydrated alumina contained in the coating liquid.

Example 8

Recording medium 8 was produced in the same way as in Example 1, except that substrate B was used in place of substrate A and that coating liquid C for an ink-receiving layer was used in place of coating liquid A for an ink-receiving layer. Table 2 shows the thickness of the ink-receiving layer of recording medium 8 and the type of inorganic pigment contained in the ink-receiving layer and the average particle size of hydrated alumina contained in the coating liquid.

Example 9

Recording medium 9 was produced in the same way as in Example 1, except that substrate C was used in place of substrate A and that coating liquid C for an ink-receiving layer was used in place of coating liquid A for an ink-receiving layer. Table 2 shows the thickness of the ink-receiving layer of recording medium 9 and the type of inorganic pigment contained in the ink-receiving layer and the average particle size of hydrated alumina contained in the coating liquid.

Example 10

Recording medium 10 was produced in the same way as in Example 1, except that substrate C was used in place of substrate A, coating liquid F for an ink-receiving layer was used in place of coating liquid A for an ink-receiving layer, and that the coating weight of coating liquid F for an ink-receiving layer was changed in such a manner that the dry coating weight of coating liquid F for an ink-receiving layer was 20 g/m$^2$. Table 2 shows the thickness of the ink-receiving layer of recording medium 10 and the type of inorganic pigment contained in the ink-receiving layer and the average particle size of hydrated alumina contained in the coating liquid.

Example 11

Recording medium 11 was produced in the same way as in Example 1, except that substrate C was used in place of substrate A, coating liquid G for an ink-receiving layer was used in place of coating liquid A for an ink-receiving layer, and that the coating weight of coating liquid G for an ink-receiving layer was changed in such a manner that the dry coating weight of coating liquid G for an ink-receiving layer was 23 g/m$^2$. Table 2 shows the thickness of the ink-receiving layer of recording medium 11 and the type of inorganic pigment contained in the ink-receiving layer and the average particle size of hydrated alumina contained in the coating liquid.

Comparative Example 1

Recording medium 12 was produced in the same way as in Example 1, except that substrate C was used in place of substrate A, coating liquid E for an ink-receiving layer was used in place of coating liquid A for an ink-receiving layer, and that the coating weight of coating liquid E for an ink-receiving layer was changed in such a manner that the dry coating weight of coating liquid E for an ink-receiving layer was 18 g/m$^2$. Table 2 shows the thickness of the ink-receiving layer of recording medium 12 and the type of inorganic pigment contained in the ink-receiving layer and the average particle size of hydrated alumina contained in the coating liquid. Recording medium 12 did not contain hydrated alumina. So, the average particle size of hydrated alumina was not measured. The cell of the average particle size of hydrated alumina in Table 2 was marked with the symbol "-".

Comparative Example 2

Recording medium 13 was produced in the same way as in Example 1, except that substrate C was used in place of substrate A and that the coating weight of coating liquid A for an ink-receiving layer was changed in such a manner that the dry coating weight of coating liquid A for an ink-receiving layer was 30 g/m$^2$. Table 2 shows the thickness of the ink-receiving layer of recording medium 13 and the type of inorganic pigment contained in the ink-receiving layer and the average particle size of hydrated alumina contained in the coating liquid.

Comparative Example 3

Recording medium 14 was produced in the same way as in Example 1, except that substrate C was used in place of substrate A and that coating liquid D for an ink-receiving layer was used in place of coating liquid A for an ink-receiving layer. Table 2 shows the thickness of the ink-receiving layer of recording medium 14 and the type of inorganic pigment contained in the ink-receiving layer and the average particle size of hydrated alumina contained in the coating liquid.

Comparative Example 4

Recording medium 15 was produced in the same way as in Example 1, except that substrate E was used in place of substrate A. Table 2 shows the thickness of the ink-receiving layer of recording medium 15 and the type of inorganic pigment contained in the ink-receiving layer and the average particle size of hydrated alumina contained in the coating liquid.

Comparative Example 5

Recording medium 16 was produced in the same way as in Example 1, except that substrate F was used in place of substrate A. Table 2 shows the thickness of the ink-receiving layer of recording medium 16 and the type of inorganic pigment contained in the ink-receiving layer and the average particle size of hydrated alumina contained in the coating liquid.

Comparative Example 6

Recording medium 17 was produced in the same way as in Example 1, except that substrate G was used in place of substrate A. Table 2 shows the thickness of the ink-receiving layer of recording medium 17 and the type of inorganic pigment contained in the ink-receiving layer and the average particle size of hydrated alumina contained in the coating liquid.

Measurement of Arithmetic Average Roughness Ra

The arithmetic average roughness Ra of the surfaces of the ink-receiving layers of the recording media 1 to 17 was measured with a measuring apparatus under measurement conditions described below.

Measuring apparatus: Surfcorder SE3500 (manufactured by Kosaka Laboratory Ltd.)

Measurement conditions: A cutoff value was set according to JIS B0601:2001. The evaluation length was set to a length five times the cutoff length.

Measurement of Specular Gloss at 60°

The specular gloss of each surface of the ink-receiving layers of recording media 1 to 17 at 60° was measured with a measuring apparatus under measurement conditions described below.

Measuring apparatus: VG 2000 (manufactured by Nippon Denshoku Industries Co., Ltd.)

Measurement conditions: Measurement conditions complied with JIS Z8741.

Table 2 shows the arithmetic average roughness of the ink-receiving layers and the specular gloss of the ink-receiving layers at 60° obtained by the foregoing measurement methods.

Evaluation of Recording Medium

Legibility

A close-up image of one person was formed by printing on each of recording media 1 to 17 with an ink jet photo printer (trade name in Japan: PIXUS MP990, manufactured by CANON KABUSHIKI KAISHA) in a glossy gold mode (standard setting). The printed recording media were placed on a desk. Each portrait image was visually checked from five positions. The legibility of the recording media was evaluated according to evaluation criteria described below. Table 2 shows the results.

A: The portrait image is clearly legible when viewed from any position.

B: The facial image of the person is slightly illegible when viewed from one position.

C: The facial image of the person is illegible when viewed from one position.

D: The facial image of the person is illegible when viewed from two or more positions.

Undertrapping

Two pieces of each of recording media 1 to 17 were prepared. Images 1 and 2 described below were formed by printing on each of recording media 1 to 17 with an ink jet photo printer (trade name in Japan: PIXUS MP990, manufactured by CANON KABUSHIKI KAISHA) in a glossy gold mode (standard setting, color/density: not matched), thereby providing recording media 1 to 17 each having image 1 and recording media 1 to 17 each having image 2.

Image 1: A 15 cm×15 cm solid image of (R, G, B)=(0, 0, 0) created using PhotoShop 7.0 in an RGB mode.

Image 2: A 5 cm×5 cm solid image of (R, G, B)=(255, 255, 0) created using PhotoShop 7.0 in an RGB mode.

Recording medium 1 on which image 1 was formed by printing and recording medium 1 on which image 2 was formed by printing were stored for 30 minutes at 23° C. and 50% RH. Two recording media 1 were superimposed and stored for 24 hours in such a manner that a region where image 1 had been formed by printing was superimposed on a region where image 2 had been formed by printing. After 24 hours, in the region of recording medium 1 where image 1 had been formed by printing, a portion where image 1 was superimposed on image 2 and a portion where image 1 was not superimposed on image 2 were visually checked. Evaluation was performed according to evaluation criteria described below. The undertrapping of recording media 2 to 17 was evaluated using the same evaluation method and evaluation criteria. Table 2 shows the results.

A: There is no difference between the image at the portion where image 1 is not superimposed on image 2 and the image at the portion where image 1 is superimposed on image 2 (undertrapping is not visually observed at the portion where image 1 is superimposed on image 2).

B: The image at the portion where image 1 is superimposed on image 2 is slightly whitened as compared with the image at the portion where image 1 is not superimposed on image 2 (undertrapping is slightly visually observed at the portion where image 1 is superimposed on image 2).

C: The image at the portion where image 1 is superimposed on image 2 is whitened as compared with the image at the portion where image 1 is not superimposed on image 2 (undertrapping is visually observed at the portion where image 1 is superimposed on image 2).

D: The image at the portion where image 1 is superimposed on image 2 is significantly whitened as compared with the image at the portion where image 1 is not superimposed on image 2 (undertrapping is significantly visually observed at the portion where image 1 is superimposed on image 2).

TABLE 2

| | | Substrate | Coating liquid for ink-receiving layer | Ink-receiving layer: Specular gloss at 60° | Ink-receiving layer: Arithmetic average roughness Ra | Ink-receiving layer: Thickness | Ink-receiving layer: Type of inorganic pigment | Average particle size of hydrated alumina | Legibility | Undertrapping |
|---|---|---|---|---|---|---|---|---|---|---|
| Example 1 | Ink jet recording medium 1 | A | A | 8.0% | 0.8 μm | 20 μm | Hydrated alumina | 144 nm | A | B |
| Example 2 | Ink jet recording medium 2 | B | A | 8.0% | 2.5 μm | 20 μm | Hydrated alumina | 144 nm | A | A |
| Example 3 | Ink jet recording medium 3 | C | A | 10.0% | 1.1 μm | 25 μm | Hydrated alumina | 144 nm | B | A |
| Example 4 | Ink jet recording medium 4 | D | A | 8.0% | 1.7 μm | 20 μm | Hydrated alumina | 144 nm | A | A |
| Example 5 | Ink jet recording medium 5 | C | A | 7.0% | 1.1 μm | 15 μm | Hydrated alumina | 144 nm | A | A |
| Example 6 | Ink jet recording medium 6 | A | B | 8.0% | 0.8 μm | 20 μm | Hydrated alumina | 168 nm | A | B |
| Example 7 | Ink jet recording medium 7 | B | B | 8.0% | 2.5 μm | 20 μm | Hydrated alumina | 168 nm | A | A |
| Example 8 | Ink jet recording medium 8 | B | C | 9.0% | 1.1 μm | 20 μm | Hydrated alumina | 118 nm | B | A |
| Example 9 | Ink jet recording medium 9 | C | C | 8.0% | 2.5 μm | 20 μm | Hydrated alumina | 118 nm | B | A |
| Example 10 | Ink jet recording medium 10 | C | F | 9.0% | 1.0 μm | 25 μm | Hydrated alumina/silica | 144 nm | A | B |
| Example 11 | Ink jet recording medium 11 | C | G | 10.0% | 1.1 μm | 25 μm | Hydrated alumina/silica | 144 nm | B | A |
| Comparative Example 1 | Ink jet recording medium 12 | C | E | 8.0% | 1.0 μm | 25 μm | silica | — | A | D |
| Comparative Example 2 | Ink jet recording medium 13 | C | A | 14.0% | 1.1 μm | 30 μm | Hydrated alumina | 144 nm | D | A |
| Comparative Example 3 | Ink jet recording medium 14 | C | D | 6.0% | 1.1 μm | 20 μm | Hydrated alumina | 300 nm | A | D |
| Comparative Example 4 | Ink jet recording medium 15 | E | A | 12.0% | 0.6 μm | 20 μm | Hydrated alumina | 144 nm | C | D |
| Comparative Example 5 | Ink jet recording medium 16 | F | A | 12.0% | 1.1 μm | 20 μm | Hydrated alumina | 144 nm | D | A |
| Comparative Example 6 | Ink jet recording medium 17 | G | A | 8.0% | 4.0 μm | 20 μm | Hydrated alumina | 144 nm | C | A |

Aspects of the present invention may thus provide a recording medium which reduces undertrapping caused by bringing a plurality of ink-receiving layers of the recording media into contact with each other and which inhibits a reduction in the legibility of an image formed on the recording medium. Furthermore, aspects of the present invention may provide a recording medium suitable for printed materials in the form of, for example, a booklet, such as a catalog or book, and print on demand.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-129270 filed Jun. 4, 2010, which is hereby incorporated by reference herein in its entirety.

What is claimed is:

1. A recording medium comprising:

an ink-receiving layer formed by applying a coating liquid onto at least one surface of a substrate and drying the coating liquid, the coating liquid containing hydrated alumina and a binder, wherein the hydrated alumina in the coating liquid has an average particle size of 100 nm to 250 nm, the surface of the ink-receiving layer has an arithmetic average roughness Ra of 0.8 μm to 2.5 μm, the arithmetic average roughness Ra being specified by JIS B0601: 2001, the surface of the ink-receiving layer has a specular gloss at 60° of 9.0% or less, the specular gloss at 60° being specified by JIS Z8741, and the ink-receiving layer has a thickness of 10 μm or more and 25 μm or less.

2. The recording medium according to claim 1, wherein the hydrated alumina content is 70% by mass or more with respect to the total mass of an inorganic pigment contained in the ink-receiving layer.

3. The recording medium according to claim 1, wherein the hydrated alumina in the coating liquid has an average particle size of 140 nm to 200 nm.

4. The recording medium according to claim 1, wherein the surface of the ink-receiving layer has an arithmetic average roughness Ra of 1.1 μm to 2.5 μm, the arithmetic average roughness Ra being specified by JIS B0601:2001.

5. The recording medium according to claim 1, wherein the surface of the substrate has a specular gloss at 60° of 7.0% or less, the specular gloss at 60° being specified by JIS Z8741.

6. The recording medium according to claim 1, wherein the substrate is resin-coated paper including a base coated with a resin.

* * * * *